United States Patent [19]

Slabaugh

[11] 4,393,896

[45] Jul. 19, 1983

[54] RADIAL VANE GAS THROTTLING VALVE FOR VACUUM SYSTEMS

[75] Inventor: Edward J. Slabaugh, San Jose, Calif.

[73] Assignee: Comptech, Incorporated, San Jose, Calif.

[21] Appl. No.: 412,251

[22] Filed: Aug. 27, 1982

[51] Int. Cl.[3] ..... F16K 13/00

[52] U.S. Cl. ..... 137/601; 415/160

[58] Field of Search ..... 137/601; 251/212; 415/155, 160, 162

[56] References Cited

U.S. PATENT DOCUMENTS

| | | | |
|---|---|---|---|
| 2,435,091 | 1/1948 | Meyer | 415/160 |
| 2,435,092 | 1/1948 | Meyer | 415/160 |
| 2,443,263 | 6/1948 | Meyer | 415/160 |
| 2,606,713 | 8/1952 | Bauger | 415/160 |
| 2,854,211 | 9/1958 | Bendersky | 415/160 |
| 4,187,879 | 2/1980 | Fermer | 137/601 |

FOREIGN PATENT DOCUMENTS

| | | | |
|---|---|---|---|
| 1091697 | 10/1960 | Fed. Rep. of Germany | 415/160 |
| 2203643 | 8/1973 | Fed. Rep. of Germany | 415/160 |
| 825547 | 12/1959 | United Kingdom | 415/155 |

*Primary Examiner*—Robert G. Nilson
*Attorney, Agent, or Firm*—Thomas Schneck

[57] ABSTRACT

A gas flow control valve wherein radially disposed vanes are mounted within an annular flange with rotationally mounted shims connecting the radial vanes to the inner peripheral surface of a flange. The shims are disposed in a rim-to-rim configuration with a groove defined in rims of the shims and a cable laid in the grooves in a serpentine pattern. By causing one of the shims to rotate by means of a sealed shaft extending through the flange, the remaining shims may be driven by the cable causing corresponding motion of the vanes. The shims are mounted to the flange by means of pins. The shims are relatively thin such that they may be hidden beneath overhanging regions on opposite side walls of the flange, exposing only the radially disposed vanes to a gas flow path. Fine and coarse control modes are achieved by allowing one of the vanes to be controlled by a shaft through the flange independent of all shims for fine mode control and another shaft driving the shims for control of the remaining vanes for coarse mode control.

15 Claims, 10 Drawing Figures

RADIAL VANE GAS THROTTLING VALVE FOR VACUUM SYSTEMS

DESCRIPTION

TECHNICAL FIELD

The invention relates to gas flow control valves and in particular to a gas throttling valve for vacuum pumping.

BACKGROUND ART

Vane-type gas flow control valves are known. In particular, U.S. Pat. Nos. 2,435,092, 2,443,263 and 2,435,091, all to H. A. Meyer, show pie-shaped vanes radially supported to individually rotate on an axis slightly below the approximate vane center line. A similar control valve is shown in U.S. Pat. No. 4,187,879 to Fermer et al.

In the prior art, radial vanes supported in a flange usually penetrate the walls of the flange for vane control purposes. Where pressure inside and outside of the flange is generally equal this presents no problem. However, where the inside and outside pressure is drastically unequal, as in vacuum systems, wall penetration of support vanes is a problem, since the penetration zones create gas leak zones. Without wall penetration the vanes cannot be readily controlled or supported.

Very low-pressure vacuum chambers are used to perform such processes as radio frequency or d.c. sputter deposition, plasma etching, low-pressure chemical vapor deposition and reactive ion etching. The process vacuum chamber must be evacuated to pressures on the order of $1\times10^{-6}$ Torr as quickly as possible to reduce overall process time. It is then necessary to gradually introduce into the process chamber a gas, usually inert, to displace the remaining air molecules. The gas is ionized by a cathode and provides a plasma source to perform a variety of processes. The processes generally require that the chamber maintain a fixed pressure, say $1\times10^{-1}$ Torr for plasma stability.

Gas throttling valves are used in such vacuum systems to maintain the desired chamber pressure by controlling the effective speed of pumping of the process chamber. At present there are two standard methods of controlling process pressures. One method, the "upstream method," requires that a throttling valve, located between the process chamber and the vacuum pump be partially closed to an accurate pre-determined position. Then, process gas is slowly introduced into the chamber by a servo controlled inlet valve to attain the proper pressure. A transducer measures the process chamber pressure and feeds an electrical signal to a controller which adjusts the opening of the servo controlled valve, thereby maintaining the proper pressure. Such a throttle valve has a pneumatic actuator to provide the open and close functions of the valve, and a micrometer barrell which provides an accurate and adjustable abutment or stop, to place the valve in the proper position for restricting effective pumping speed.

In a second method, the "downstream method," requires that the pneumatic actuator and micrometer assembly on the throttling valve be replaced by a servo drive motor directly coupled to a shaft. The valve may then be modulated by electrical signals sent to it from the servo controller. A gas inlet valve is opened to a fixed position and process pressure is maintained downstream of the chamber by effective modulation of the throttling valve.

Prior art throttling valves have used iris-type vanes and semiphore shutter-type vanes. One of the problems with such vanes is that sometimes the interior mounting of the vanes, within the inner periphery of a flange, baffles the flange aperture so that the full aperture is not available when the vanes are fully open.

DISCLOSURE OF INVENTION

An object of the invention was to devise a radial vane gas flow control valve wherein the vanes are supported within a flange, but flange wall penetration by control or support members is minimized.

Another object was to devise a means for mounting radial vanes within a flange so that the flange opening is not baffled when the vanes are fully open.

Another object was to provide a precision throttling valve adapted for coarse and fine gas pressure control of vacuum chambers.

The above object has been achieved by mounting specially constructed rotating shims about the curved inner peripheral flange region through which gas flows. The purpose of the shims is to support radially disposed vanes and to transmit motion both to the supported vanes and to neighboring shims. Each shim has an outer toric surface, usually a truncated hemisphere, which matches the curvature of inner periphery of the flange at least along a line parallel to the plane of a supported vane so that the shims block gas flow between the inner peripheral flange region and the outer surface of the shim. Vanes are supported on a side of the shims opposite the toric surface. In this way the shims can rotate within the flange, yet form a quasi-seal between a vane and the inner periphery of the flange. By placing the shims in an endless rim-to-rim configuration, rotational motion can be communicated from one shim to the next either by gear teeth or by a cable wrapped around the rims in a serpentine path.

A sealed bearing is used to transmit rotational energy from outside the flange to one of the shims, a driver shim. In turn, the driver shim transmits rotational energy to the other, driven, shims from rim-to-rim.

In one embodiment, a single actuator transmits rotational energy to the driver shim which, in turn, transmits rotational energy to all of the other shims and vanes. In a second embodiment, the driver shim transmits rotational energy to all of the vanes except one which is independently controlled. The latter vane is used for fine servo correction, while the remaining vanes are used for coarse valve control, using a servo controller.

If the flange provides a gas barrier between its outer and inner peripheral surfaces, the gas flow control valve of the present invention is ideal for use in vacuum systems. An advantage of the invention is that when the vanes are fully open, the flange opening is not baffled, thereby allowing a maximum number of gas molecules to pass through the flange opening. Another advantage is that if two shims are independently driven, coarse and fine servo control may be achieved.

BEST MODE FOR CARRYING OUT THE INVENTION

Figure 1:
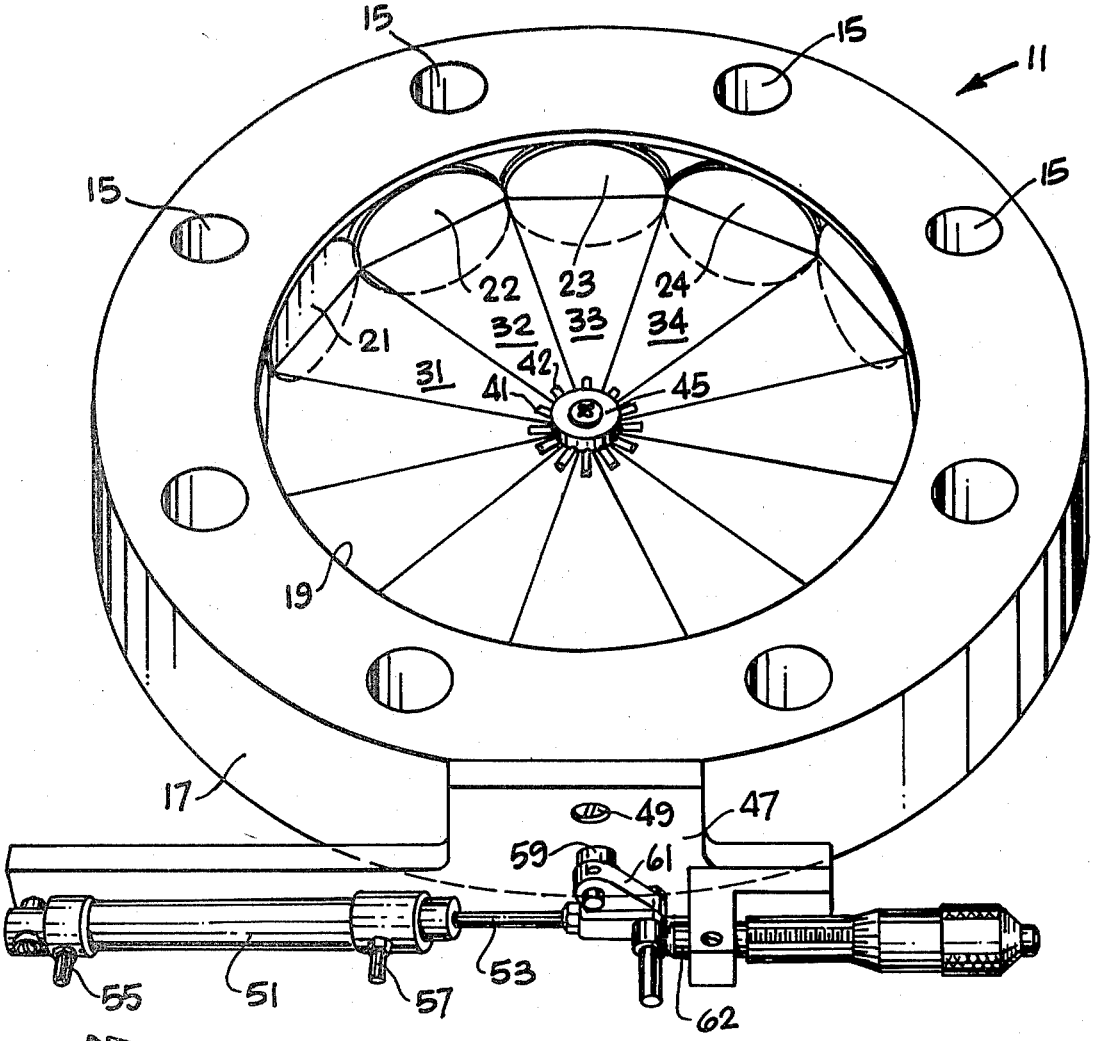
FIG. 1 is a perspective view of a gas throttling valve, with the vanes in a closed position, in accord with the present invention.

With reference to FIG. 1, a throttling valve of the present invention is illustrated. The valve is housed in an annular flange 11 having an upper side 13 and an opposed lower side, not shown. A plurality of holes 15 extends through the opposed sides of the flange, but does not break the gas barrier relationship between the outer peripheral surface 17 and the inner peripheral surface 19. Between upper side 13 and the opposed side, spaced circumferentially about the inner peripheral surface of the flange are a number of rotatable shims 21, 22, 23, 24, and so on. Each of these shims occupies a space between a corresponding connected vane 31, 32, 33, 34, and so on and the inner peripheral surface 19 of the flange. The shims are mounted for rotation, like bearings, within the flange and carry the vanes with them. Each vane has a corresponding tip 41, 42, and so on held within a hub 45 in a manner such that the tips 41, 42 can rotate within the hub 45. The shims are mechanically coupled, as explained below, such that one shim, a driver shim, can couple rotational energy from outside the flange to the driver which, in turn, transmits energy to the remaining driven shims. A bracket 47 is connected to the outer peripheral surface 17 by means of screw 49. Bracket 47 carries an actuator 51 having a plunger 53 controlled by fluid inputs to orifices 55 and 57. A servo controller may supply fluid to the orifices so that a piston within the actuator 51 is moved back and forth, controlling the motion of plunger 53 so that the desired valve opening is obtained.

Plunger 53 turns a shaft 59 connected to a sealed bearing which couples rotational motion imparted by a crank 61, the distant end of which is moved by plunger 53. A manually operated stub 63 is available as an alternative to use of actuator 51. A manually or electrically operated micrometer barrel 65 is used to adjust sleeve 67 which provides an abutment or stop for the outward end of crank 61. The micrometer barrel 65 may also be used to measure the crank position at various valve settings.

Figure 2:
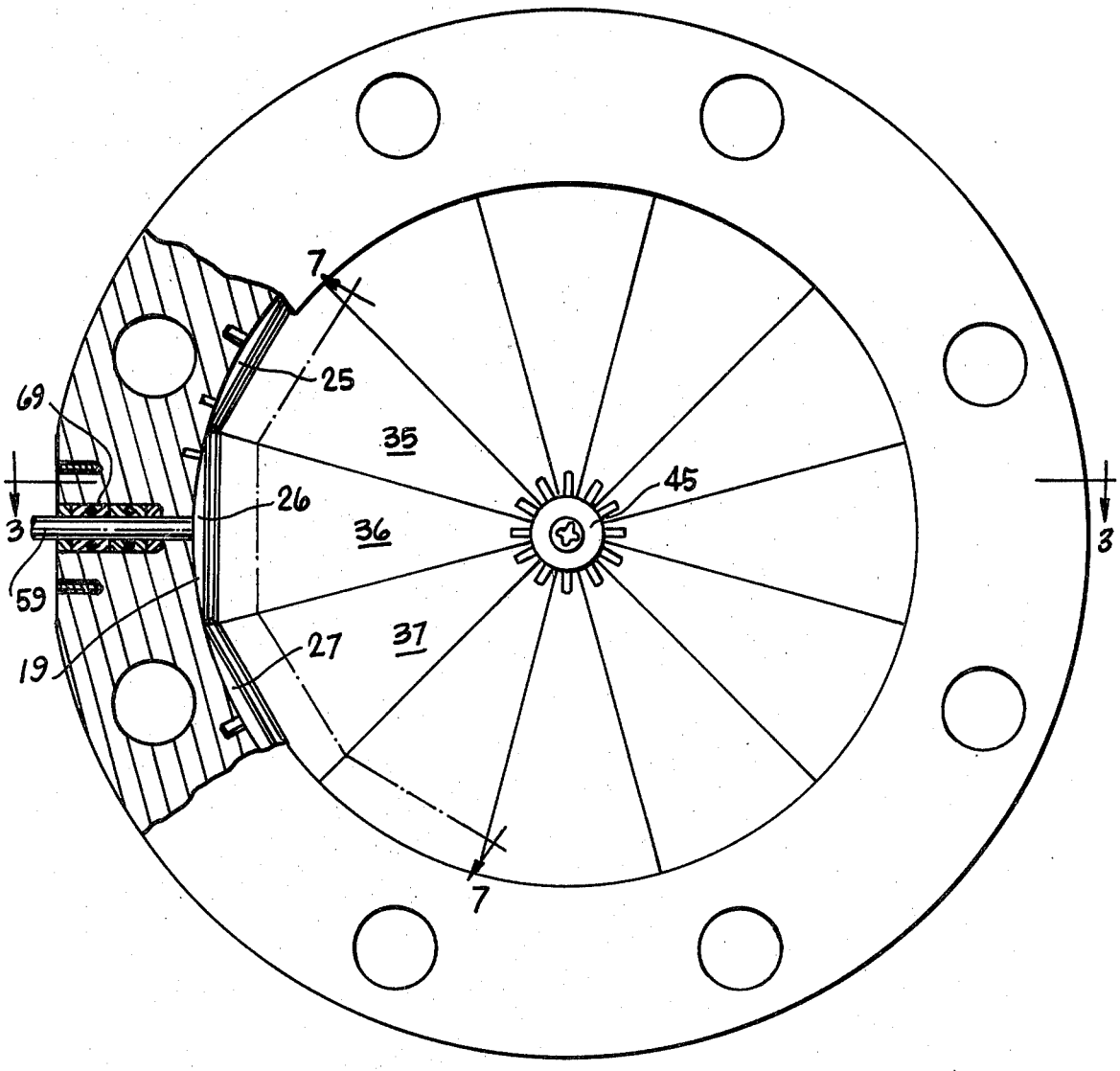
FIG. 2 is a top partially cutaway view of the valve of FIG. 1.

With reference to FIG. 2, the shims 25, 26 and 27 may be seen to block the space between vanes 35, 36, 37 and the inner peripheral surface 19 of the flange. The side of a vane which faces the inner peripheral surface of the flange is a toric surface. A toric surface is usually defined as a portion of the surface of a torus. A torus usually has two radii, including a major radius for the entire torus and a minor radius which is the cross sectional radius. In the present case, a toric surface refers to the fact that the surface has a major radius corresponding to the radius of the inner peripheral surface. The arc defined by this radius lies in the same plane as a vane supported by the shim. In this manner, when the vanes are in the closed position, the arcs on adjacent shims are aligned such that rim-to-rim contact of the shims seals the opening through the flange. In order to do this, it is only necessary that the shims have arcs in the plane of the vane that match the interior peripheral surface of the flange. The remainder of the shim can have other curvatures. This surface is termed a toric surface because the other curvatures may cause the shim to resemble the surface of a spectacle lens, frequently a toric surface.

Shaft 59 is a portion of a sealed bearing which includes a shaft seal 69 of a commercially available type, such as a Ferrofluidic seal or conventional O-ring shaft seals.

Figure 3:
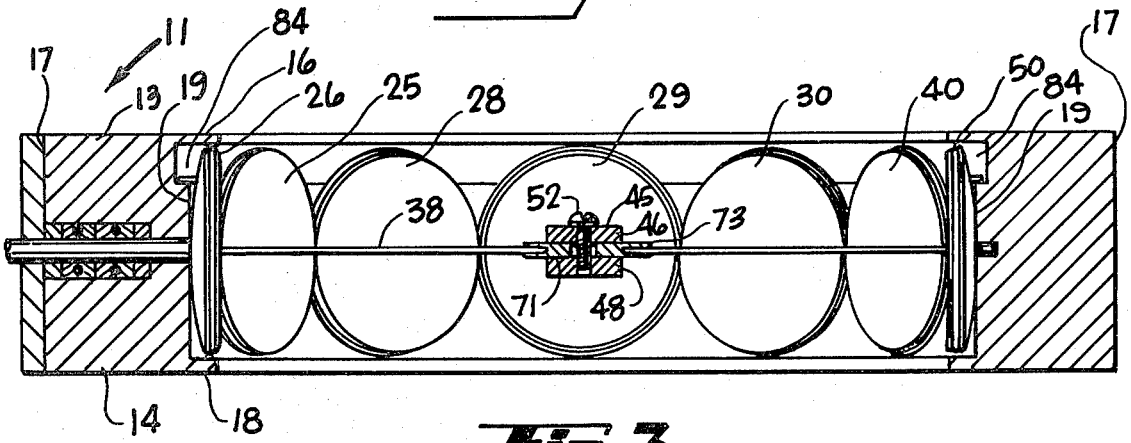
FIG. 3 is a sectional view of the valve of FIG. 2 taken along lines 3—3.

With reference to FIG. 3, the rim-to-rim alignment of the shims 26, 25, 28, 29, 30, 40 and 50 may be seen. The shims are in a position such that the vanes connected to the shims form a common plane 38 such that the valve is in a closed position. It will be seen that flange 11 has the outer peripheral surface 17 spaced from the inner peripheral surface 19. Surface 19 exists between opposed sides, including the upper side 13 and the lower side 14. Both of these sides have lip regions 16 and 18, respectively, which form overhanging regions, hiding the shims with respect to a gas flow path, i.e., between a pump and a chamber. Thus, except for hub 45, the gas flow pattern encounters only the vanes for a very low impedance path when the valve is fully open. There is no baffling of the vanes by the shims, as in prior art devices.

The hub 45 may be seen to be constructed of two disks 46 and 48, connected together by a screw 52. The two disks have slots for receiving rounded pins 71, 73 associated with vanes. The reason that the two-disk hub construction is important is that it permits assembly of the vanes and shims which are mounted before the hub is positioned. Only after the hubs and shims have all been mounted, the hub is put into place.

Figure 4:
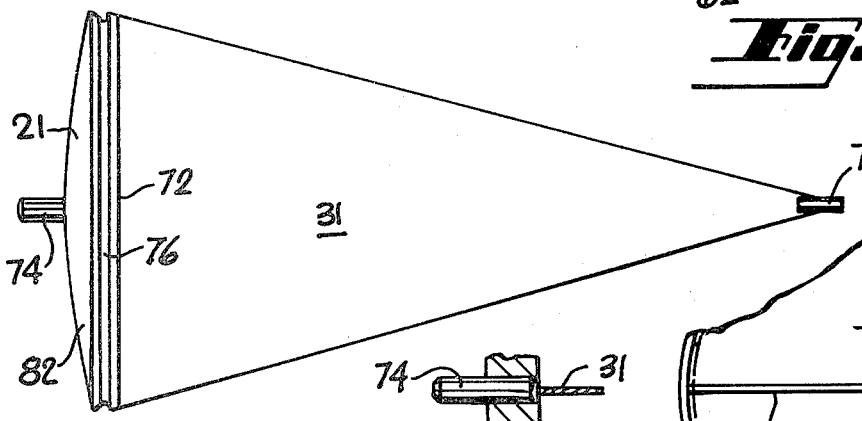
FIG. 4 is a side view of a shim and radial vane in accord with the present invention.

FIG. 4 shows a representative shim 21 with a toric outer surface 82 matching the curvature of the inner peripheral surface of the flange. The opposite side of the shim supports a vane 31. Note that the vane is wedge-shaped with a wedge tip 71, a pivot pin which fits into a corresponding opening in the hub. The opposite side of the vane is a base 72 which is supported by the shim along a line which lies in the same plane as the arcuate region of the toric surface of the shim which matches the curvature of the inner peripheral region of the flange. The toric surface 82 has a pin 74 extending therefrom for mounting in a shallow bore of the inner peripheral surface of the flange.

Figure 5:
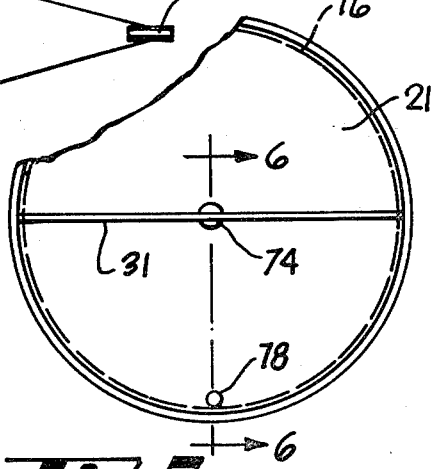
FIG. 5 is an inward, cutaway, elevation of the shim and vane of FIG. 4.

In FIG. 5, the projection of the toric surface may be seen to be circular with pin 74 at the center of the circle and the plane of the vane 31 passing through the center. In FIGS. 4 and 5 the shim 21 may be seen to have a groove 76 about the rim of the shim. The purpose of the groove is to carry a cable which provides rim-to-rim transfer of motion between shims. Alternatively, the rim could be provided with teeth for meshing contact between adjacent shims. The circular configuration of the shims implies that the toric surface of the shim is a truncated hemisphere. This is a preferred shape because of ease of fabrication. Each shim carries a guide stub which fits into an optional slot provided about the circumference of the inner peripheral surface of the flange.

Such a guide slot might have a width equal to, say 20% of the width of the flange between opposed sides. The purpose of such a slot, illustrated in FIG. 3 as slot 84, is to limit the amount of rotation of the shims from 0 degrees when the shims are all in the same plane to approximately 90 degrees when the valve is fully open. In other words, the slot 84 prevents the vanes from being inclined at an angle of more than 90 degrees.

Figure 6:
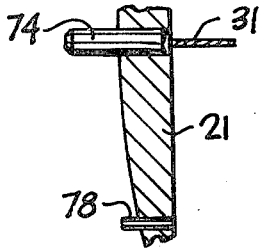
FIG. 6 is a sectional view of the shim of FIG. 5, taken along lines 6—6.
Figure 7:
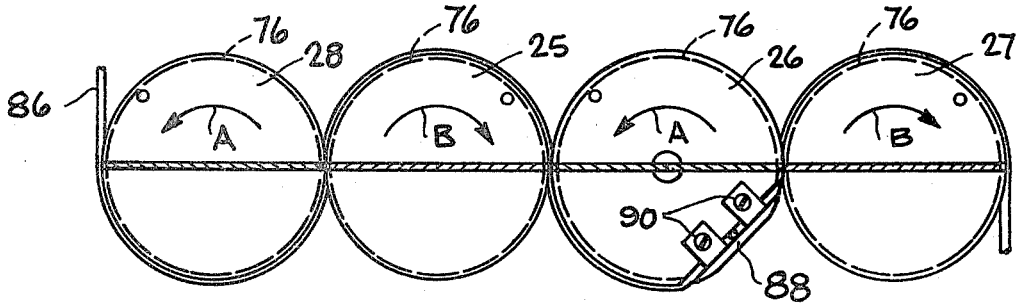
FIG. 7 is a radial view of rim-to-rim alignment and mounting of shims, taken along lines 7—7 of FIG. 2.

In FIG. 6, the guide stub 78 is seen to protrude in the same direction as the mounting pin 74. Transfer of rotational motion between shims is illustrated in FIG. 7 wherein side-by-side alignment of shims 28, 25, 26 and 27 is illustrated. A cable 86 is seen to be wrapped in a serpentine pattern about the grooves 76, indicated by dashed lines, in each shim. The ends of the cable may be clamped by a keeper 88 connected to a flat spot in a shim and held in place by the screws 90. The serpentine pattern of the cable causes adjacent shims to rotate in opposite directions as indicated by the arrows A and B.

Figure 8:
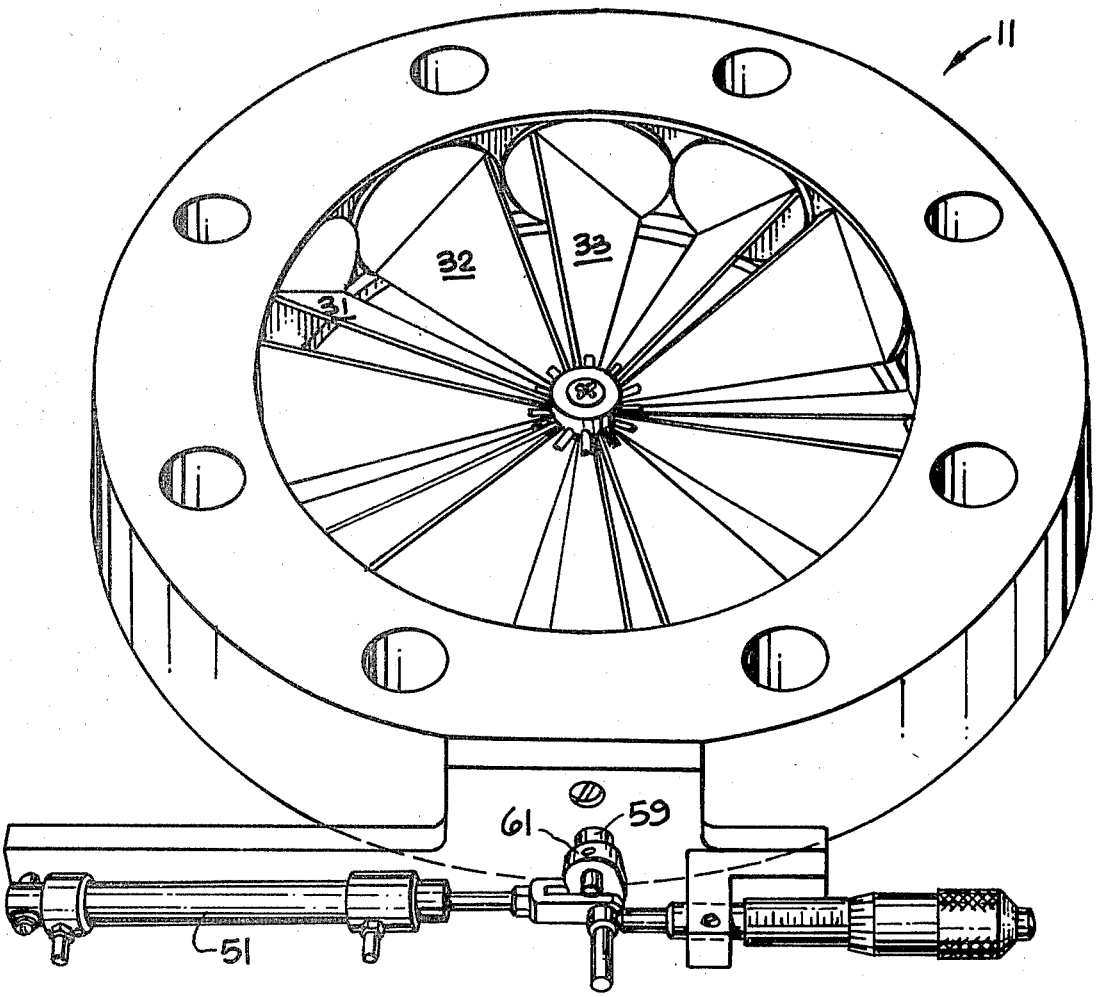
FIG. 8 is a perspective view of the gas valve of FIG. 1 with vanes in a partially open position.

With reference to FIG. 8, the vanes 31, 32, 33 and so on are seen to have rotated slightly upon movement of the crank 61. In this position, the valve is slightly open, allowing gas flow therethrough. The micrometer barrel could be advanced to measure the position of the crank or may be left in place to act as a stop at a desired position.

Note that the penetration of a single shaft 59 through and annular flange 11 minimizes the opportunity for gas leakage. While this advantage makes the valve very useful for vacuum systems applications, it will be realized that the valve can also be used in non-vacuum applications where gas flow is to be regulated.

Figure 9:
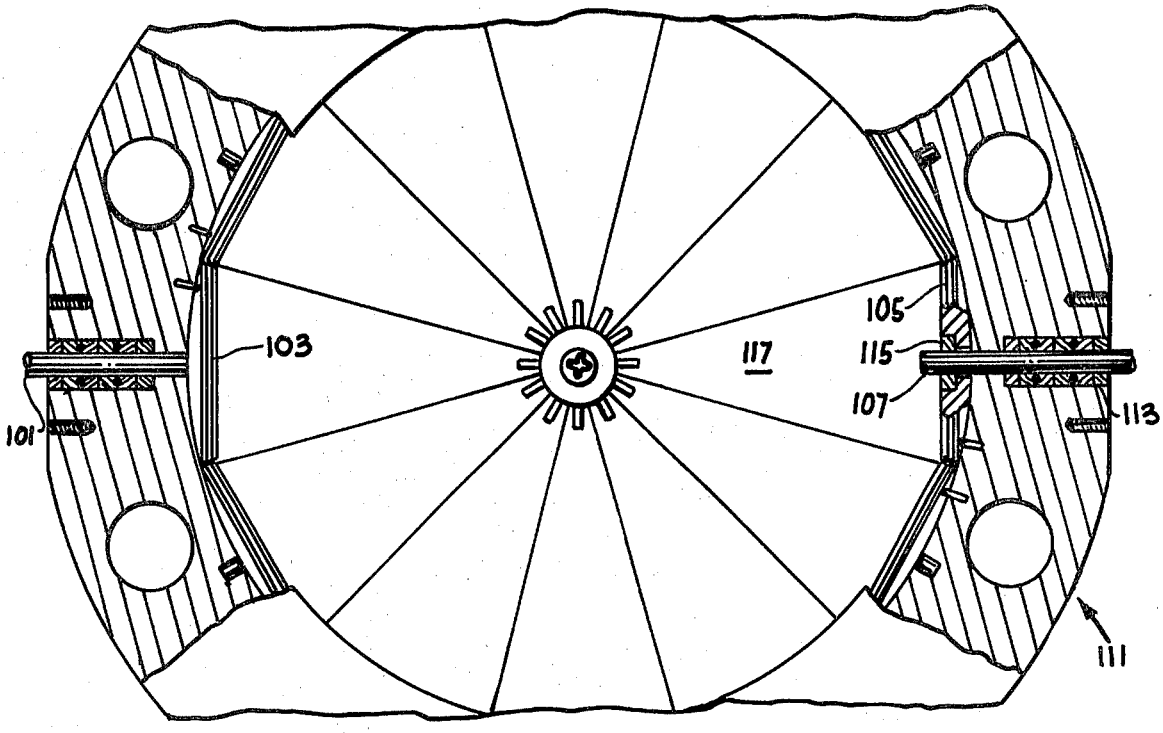
FIG. 9 is a top partially cutaway view of an alternate embodiment of the invention.

With reference to FIG. 9, an alternate embodiment of the invention is illustrated. In this embodiment, all of the vanes except one are controlled by rotational energy transmitted to the shims by shaft 101 to the driver shim 103. All of the shims operate in the usual way except that shim 105 has a shaft 107 extending through the shim. The shaft is rotationally independent of the shim. Shaft 107 extends through flange 111 in a sealed relationship by means of the shaft seal 113. Vane 105 has another shaft seal 115 in the shim supporting the shaft in a manner so that it can rotate independently of the shim. Shaft 107 is directly connected to vane 117 by direct attachment, such as a slit in the end of the shaft, with the side of the vane opposite the tip fitting into the shaft slit. In FIG. 9 it will be seen that there are a total of 12 vanes. If all of the vanes were driven by the driver shim, any vane motion would be multiplied 12 times since the driver shim controls 11 other shims. However, in the configuration illustrated in FIG. 9, the driver shim controls only 11 vanes, with vane 117 being independently controlled by shaft 107. Shaft 101, which controls the driver shim 103, can provide coarse control of a valve, for initial pumping or when fine control is not necessary. Once the desired pressure is achieved, fine control of the valve may be maintained by maintaining all of the vanes, except vane 117, in a fixed position and independently operating vane 117 to provide desired fine correction. A servo controller can provide signals to actuators or motors which are controlling shafts 101 and 107. Such servo controllers are known. A servo controller having independent coarse and fine corrections may be used, or alternatively, two controllers may be used including one which is operative only during coarse corrections and the other which is operative once coarse corrections are completed and only fine corrections are needed. A closed loop servo system can identify when coarse corrections have achieved a desired pressure threshold. Below the desired pressure threshold, only fine corrections are used.

Figure 10:
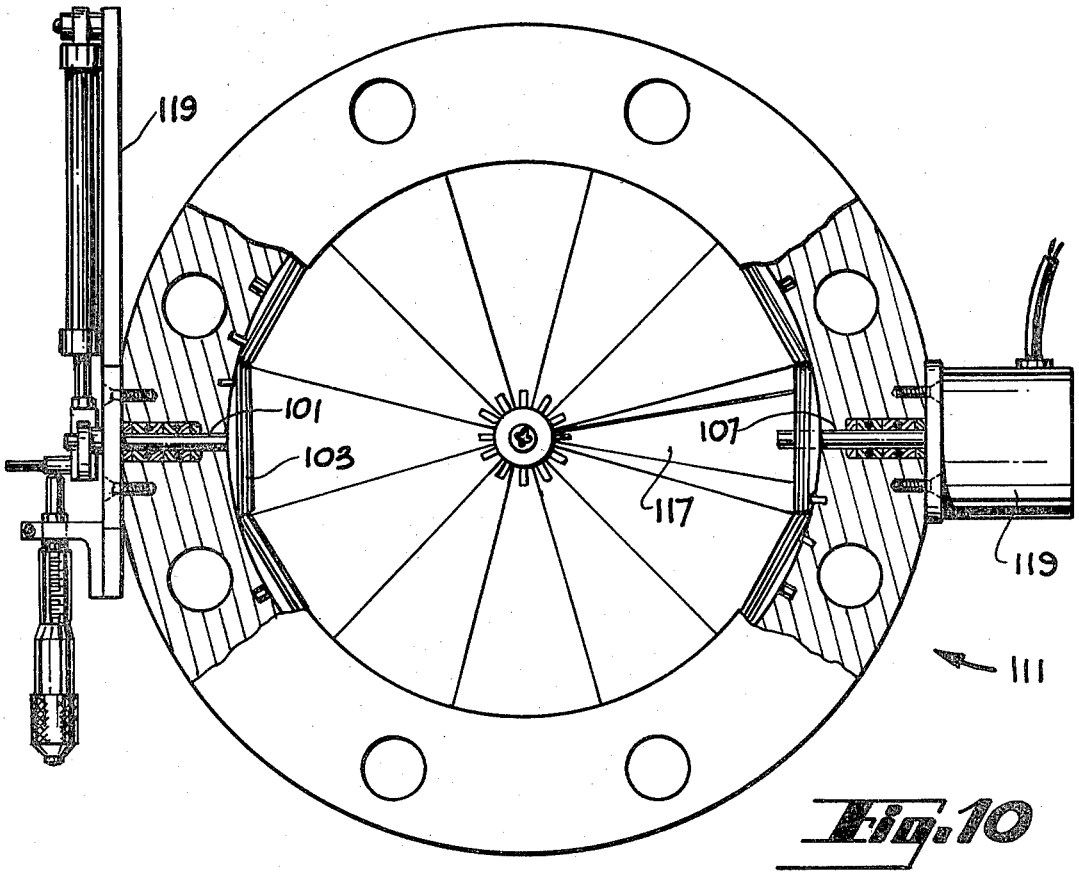
FIG. 10 is a view similar to FIG. 9 illustrating operation of the apparatus.

Corrections may be applied by a pair of stepper motors or by an actuator of the type illustrated in FIG. 1 for coarse corrections and a stepper motor for fine corrections. FIG. 10 is an operational view of the valve of FIG. 9 wherein an actuator 119 is used to control shaft 101, shim 103 and all of the other shims. The actuator is keeping the vanes of such shims in a position which would seal the orifice through flange 111.

One of the vanes, namely vane 117 is being independently controlled by shaft 107 which is being driven by motor 119. The vane 117 is shown in an inclined position which is different from the other vanes. In this position, gas can pass through the vanes from one side of the flange to the other. The view of FIG. 10 illustrates fine control used in the situation where coarse control is no longer in effect. During fine control, motor 119, by itself, operates vane 117, the only vane which moves during fine correction.

The concept of coarse and fine control need not be restricted to radial vane throttling valves, but may also be used in other kinds of vacuum throttling valves employing vanes. The control mechanism of the present invention may be thought of as a group of N vanes adapted to open and close an orifice defined within a flange with independent controls of two sets of vanes. A first set consists of (N−1) vanes which are mechanically linked for joint motion, such as by the rotatable shims described above. The first group of vanes is then mechanically linked through a shaft or other coupling means supported in the flange which opens and closes the vanes. A second group of vanes, namely the Nth vane, is independently linked to a second coupling means supported in the flange which communicates opening and closing motion from outside the flange to the vane, bypassing the first coupling means. In FIG. 10, this is done by means of a shaft which penetrates one of the shims and rotates independently of it. In this manner, (N−1) vanes provide coarse control, while the Nth vane provides fine control. Both coarse and fine control modes are in response to electrical signals from a controller in a closed loop servo loop.

I claim:

1. A gas flow control valve comprising:

an annular flange having a continuous inner peripheral surface and a spaced apart, outer peripheral surface connected to the inner peripheral surface in a gas barrier relation between opposed side walls, a plurality of movable vanes disposable in a common plane closing the inside of the annular flange, said common plane parallel to the flange side walls, said vanes radially mounted for rotational shutter-like movement out of said common plane by inclining on an axis out of said common plane, a plurality of rotatable shims having an outer toric surface, matching the curvature of the inner peripheral surface of the flange and having a rotational support means for connection to the inner peripheral surface of the flange, each shim having a support side connected to a vane for transmitting shim rotation to a connected vane and further having rim means for transmitting rotational motion to rim means of adjacent shims, and the shims arranged in an endless rim-to-rim motive communication relation, coupling means supported in the flange from the outside peripheral region to the inside peripheral region for communicating rotary motion from outside the flange to one of the shims.

2. The valve of claim 1 wherein said rim means comprises, a groove about the periphery of each shim rim and a cable laid in a serpentine path from groove to groove of adjacent shims, the cable frictionally engaging the rim of each shim.

3. The valve of claim 1 wherein said toric surface of said shims matches the curvature of the inner peripheral surface of the flange at least along a line in said common plane of the vanes.

4. The valve of claim 1 wherein said toric surface of said shims is a surface portion of a sphere.

5. The valve of claim 1 wherein said rotary support means of each shim comprises a pivot pin adapted to fit in a matching hole defined within the inner peripheral region of the flange.

6. The valve of claim 5 wherein said rotary support means of each shim comprises a guide pin adapted to fit in a circumferential groove defined within the inner peripheral surface of the flange.

7. The valve of claim 1 wherein one of said shims is a drive shim and the remainder of said shims are driven shims, said drive shim connected to a shaft associated with said coupling means, said shaft extending from the drive shim through the peripheral surfaces of the flange to a control means located outside the flange for applying rotary energy to the shaft whereby rotary energy is transmitted to said shims in rim-to-rim motive communication relation from the drive shim to the driven shims.

8. The valve of claim 1 wherein said movable vanes are wedge shaped vanes each having a wedge point and a wedge base opposite the point, the wedge point adapted for rotation in a hub.

9. The valve of claim 8 further defined by a hub comprising two connected disks having a plurality of apertures defined in a disk circumferential region for receiving said wedge points.

10. In a gas flow control valve of the type having an annular flange with a curved inner peripheral region through which gas flows and a plurality of radially mounted vanes for shutter-like rotational movement parallel to and perpendicular to gas flow for respective open and closed valve positions, the improvement comprising, a plurality of rotatable shims mounted about the inner periphery of the flange, the shims having an outer toric surface having at least one surface arcuate region matching the curvature of the inner peripheral flange surface where the shims are mounted, the shims further having a rotational support means for connection to the inner peripheral surface of the flange, each shim having a support side connected to a vane for transmitting shim rotation to a connected vane and further having rim means for transmitting rotational motion to rim means of adjacent shims, the shims arranged in an endless rim-to-rim motive communication relation, and a sealed shaft means supported in the flange, extending from outside the flange to one of the shims for communicating rotary motion from outside the flange to one of the shims.

11. In a gas flow control valve of the type having an annular flange with a curved inner peripheral region through which gas flows and a plurality of radially mounted vanes for shutter-like rotational movement parallel to and perpendicular to gas flow for respective open and closed valve positions, the improvement comprising, a plurality of rotatable shims mounted about the inner periphery of the flange, the shims having an outer toric surface having at least one surface arcuate region matching the curvature of the inner peripheral flange surface where the shims are mounted, the shims further having a rotational support means for connection to the inner peripheral surface of the flange, each shim, except the Nth shim, having a support side connected to a vane for transmitting shim rotation to a connected vane and further having rim means for transmitting rotational motion to rim means of adjacent shims, the shims arranged in an endless rim-to-rim motive communication relation, a first sealed shaft means supported in the flange, extending from outside the flange to one of the shims for communicating rotary motion from outside the flange to one of the shims, controlling all vanes except one for coarse valve control, and a second sealed shaft means supported in the flange, extending from outside the flange through the Nth shim for communicating rotary motion from outside the flange to a connected vane rotationally independent of the Nth shim and all other vanes for fine valve control.

12. A gas flow control valve comprising, a group of N vanes adapted to open and close an orifice within a flange with (N−1) vanes being mechanically linked for joint motion to a coupling means supported in the flange for communicating opening and closing motion from outside the flange to the (N−1) vanes and an Nth vane being independently linked to a second coupling means supported in the flange for communicating opening and closing motion from outside the flange to the Nth vane, and control means operating the (N−1) vanes and the Nth vane independently of each other in response to electrical signals for providing coarse valve control by the (N−1) vanes and fine control by the Nth vane.

13. The valve of claim 12 wherein said first and second coupling means are shafts supported in the flange.

14. The valve of claim 13 wherein said control means includes a pair of stepper motors, each connected to a shaft.

15. The valve of claim 13 wherein said control means includes a stepper motor and an actuator, each connected to a shaft.

* * * * *